US011412899B1

(12) United States Patent
Frisby

(10) Patent No.: US 11,412,899 B1
(45) Date of Patent: Aug. 16, 2022

(54) BACK AND SHOULDER WASHING MACHINE

(71) Applicant: Reginald Frisby, Bowie, MD (US)

(72) Inventor: Reginald Frisby, Bowie, MD (US)

( * ) Notice: Subject to any disclaimer, the term of this patent is extended or adjusted under 35 U.S.C. 154(b) by 305 days.

(21) Appl. No.: 16/902,461

(22) Filed: Jun. 16, 2020

(51) Int. Cl.

| | |
|---|---|
| ***A47K 7/02*** | (2006.01) |
| ***A47K 7/04*** | (2006.01) |
| ***A47K 3/28*** | (2006.01) |
| *A46B 9/00* | (2006.01) |
| *A46B 15/00* | (2006.01) |
| *A46B 13/02* | (2006.01) |
| *E03C 1/04* | (2006.01) |

(52) U.S. Cl.
CPC ..... *A47K 7/024* (2013.01); *A47K 3/281* (2013.01); *A47K 7/04* (2013.01); *A46B 9/005* (2013.01); *A46B 13/02* (2013.01); *A46B 15/0097* (2013.01); *A47K 2201/02* (2013.01); *E03C 1/0408* (2013.01)

(58) Field of Classification Search
CPC ..... A47K 7/024; A47K 7/04; A47K 7/046; A47K 7/022; A47K 7/02; A47K 3/281; B05B 1/14; B05B 1/16; B05B 1/18; B05B 7/04; B05B 15/62; E03C 1/0408
See application file for complete search history.

(56) References Cited

U.S. PATENT DOCUMENTS

| | | | | |
|---|---|---|---|---|
| 4,014,051 | A * | 3/1977 | Pettit | A47K 7/024 4/615 |
| 5,239,712 | A * | 8/1993 | Kinder | A47K 7/04 4/606 |
| 5,345,640 | A | 9/1994 | Goss | |
| D358,258 | S * | 5/1995 | Gingras | D28/63 |
| 5,774,907 | A | 7/1998 | Doggwiler | |
| 7,451,513 | B2 * | 11/2008 | Torres | A47K 7/024 4/606 |
| 9,626,643 | B2 * | 4/2017 | Heitner | G06Q 10/087 |
| 2017/0202406 | A1 * | 7/2017 | Aguilar | A47K 7/024 |

FOREIGN PATENT DOCUMENTS

| | | | | |
|---|---|---|---|---|
| CN | 111035295 A * | 4/2020 | | A47K 7/04 |
| KR | 101895471 B1 * | 5/2017 | | A47K 7/04 |

* cited by examiner

*Primary Examiner* — Laura C Guidotti
(74) *Attorney, Agent, or Firm* — Sanchelima & Associates, P.A.; Christian Sanchelima; Jesus Sanchelima

(57) ABSTRACT

A back and shoulder cleansing machine for a shower wall is disclosed. The device mounts to the wall using suction cups and is connected to the shower head water supply for dispensing water and soap from the brush body. Additionally, the brush body rotates and also has a pair of elevated brushes extending from the main device. The elevated brushes are also configured to have a swiveling motion and are then used to wash a person's shoulders. Additionally, the main body includes a refillable soup revivor which is accessed from a top end of the main body. Excess water from within the main body is then dispensed from a release valve at the bottom end of the main body.

11 Claims, 4 Drawing Sheets

BACK AND SHOULDER WASHING MACHINE

BACKGROUND OF THE INVENTION

1. Field of the Invention

The present invention relates to a body washing machine and, more particularly, to a back and shoulder washing machine that attaches to a shower wall to includes extendable spinning brushes to wash a user's back and shoulders.

2. Description of the Related Art

Several designs for a body washing machine have been designed in the past. None of them, however, include a back and shoulder cleansing machine for a shower wall. The device mounts to the wall using suction cups and is connected to the shower head water supply for dispensing water and soap from the brush body. Additionally, the brush body rotates and also has a pair of elevated brushes extending from the main device. The elevated brushes are also configured to have a swiveling motion and are then used to wash a person's shoulders. Additionally, the main body includes a refillable soap reservoir which is accessed from a top end of the main body. Excess water from within the main body is then dispensed from a release valve at the bottom end of the main body. It is known that the back and shoulders of a person is usually the hardest area for a person to clean by themselves and maintain proper hygiene. It is also known that improper hygiene of the back and shoulders can lead to damaged skin and excess unwanted back acne. Therefore, there is a need for a back and shoulder washing machine to aid in maintaining proper hygiene for a user.

Applicant believes that a related reference corresponds to U.S. Pat. No. 5,774,907 issued for a shower wall mounted back scrubber wherein the scrubber is connected to the shower head and can dispense water and soap. Applicant believes another related reference corresponds to U.S. Pat. No. 5,345,640 issued for a motorized back scrubbing soap dispensing washing device. However, the cited references differ from the present invention because the fail to disclose the extendable elevated brushes that are attached to the main body of the device. The elevated brushes extend outwardly from the main body to provide a user with an optimal back scrub. Additionally, these elevated brushes also have a swiveling motion which further aid in cleaning a user's back and is not disclosed by any of the cited references.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a back and shoulder washing machine which provides an effective way to wash and massage the back.

It is another object of this invention to provide a back and shoulder washing machine which offers an alternative to struggling with a hand-operated scrubbing tool by eliminating the need to reach and strain.

It is still another object of the present invention to provide a back and shoulder washing machine which enhances comfort and convenience for a user and is further easy to install in a shower environment.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
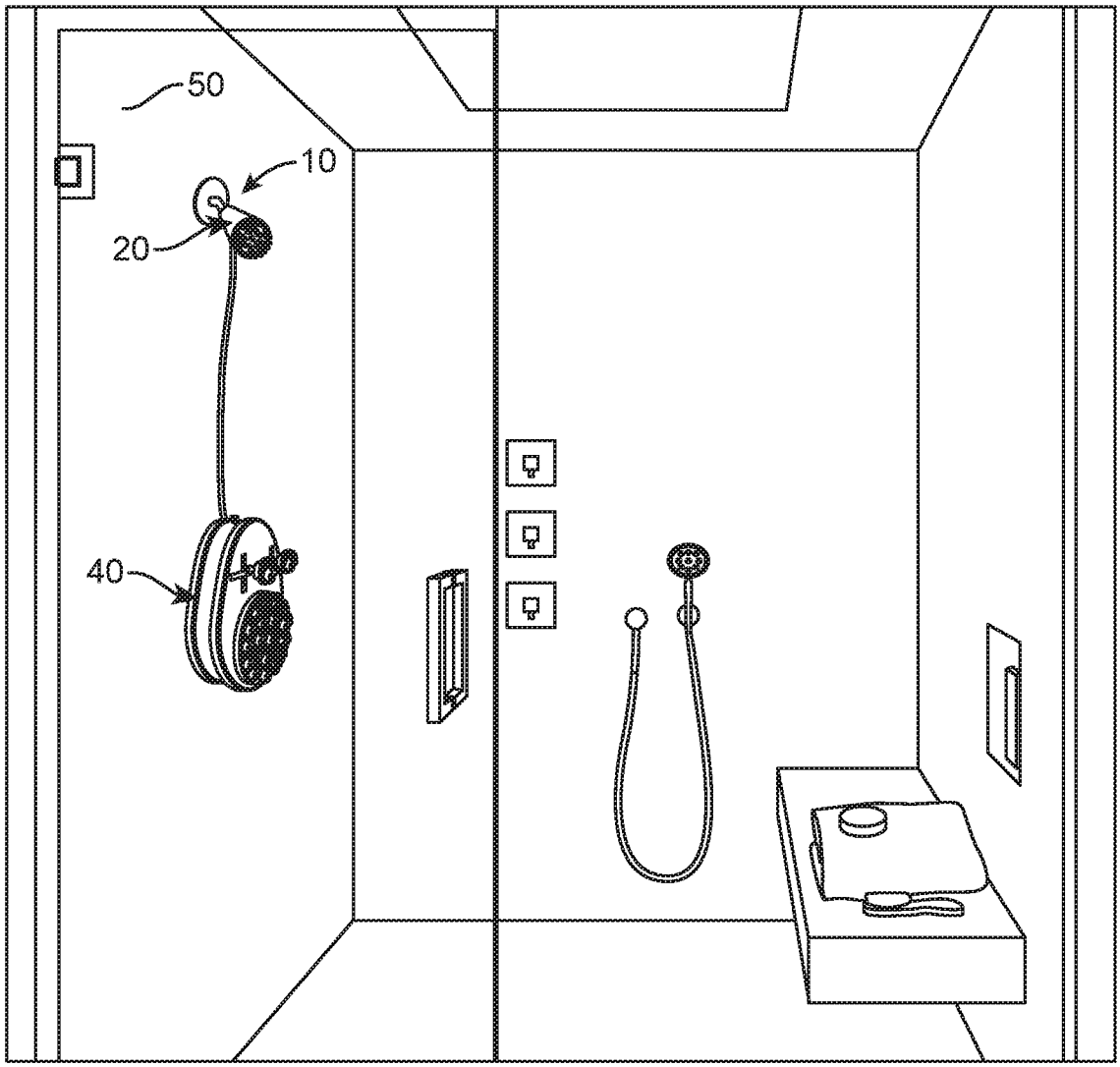
FIG. 1 represents an operational view of a back and shoulder washing system 10 mounted onto a shower wall 50 in accordance to an embodiment of the present invention.

Referring now to the drawings, where the present invention is generally referred to with numeral 10, it can be observed a system for a back and shoulder washing machine 10 which basically includes a shower head assembly 20 and a brush body assembly 40.

Figure 3:
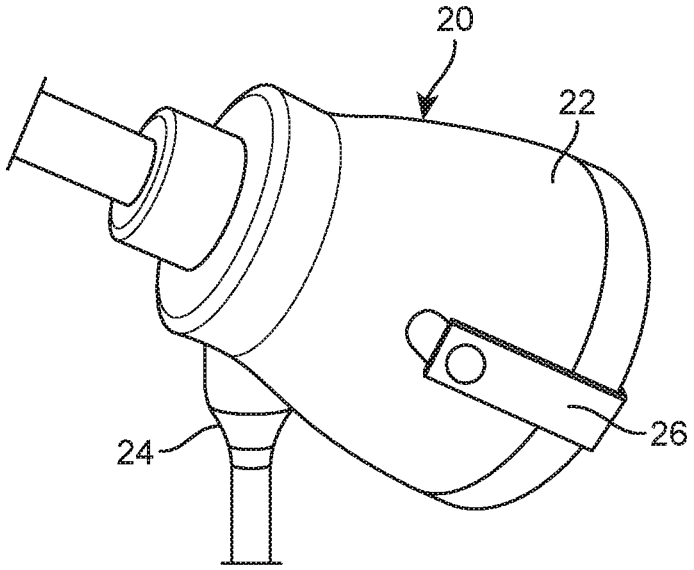
FIG. 3 illustrates an enlarged isometric view of shower head assembly 20 depicting hose 45 attached to a bottom end in accordance to an embodiment of the present invention.

Shower head assembly 20 includes a shower head 22 which is mounted on a shower wall 50 of a shower area. In one embodiment, shower head 22 has a conical shape and is connected to an internal plumbing of shower wall 50. Shower head 22 maybe represented as any traditional wall mounted shower head that is located in a user's shower area. Shower head 22 also has a front end with a plurality of nozzles from which water is dispensed from onto a user in the shower area. Continually, shower head 22 is provide with different spray options as seen in traditional shower heads. Additionally, shower head 22 includes a hose receiving member 24 located at a bottom end. Hose receiving member 24 is establishes a connection point to brush body assembly 40 that allows water to flow therethrough. In one implementation, hose receiving member 24 may be removable when not in use. Continually, shower head 22 includes a switch 26 located along a side end as observed in FIG. 3 of the provided specifications. Switch 26 allows a user to change the direction of water being fed therein shower head 22. Once engaged, switch 26 may change the direction of flow of the water to be fed into brush body assembly 40. Once disengaged, the flow of water to brush body assembly 40 is restrained and water is only dispensed from the front end of shower head 22. In one implementation, switch 26 is provided as a gate switch having a rectangular shape.

Brush body assembly 40 includes a body 42 having a substantially ovular shape. Additionally, body 42 includes a front end 42A, a rear end 42B, and sidewalls 42C. Front end 42A and rear end 42B are flat side ends which cooperate with the ovular shape of body 42. Sidewalls 42C join both front end 42A and rear end 42B to create a container like body.

Figure 2:
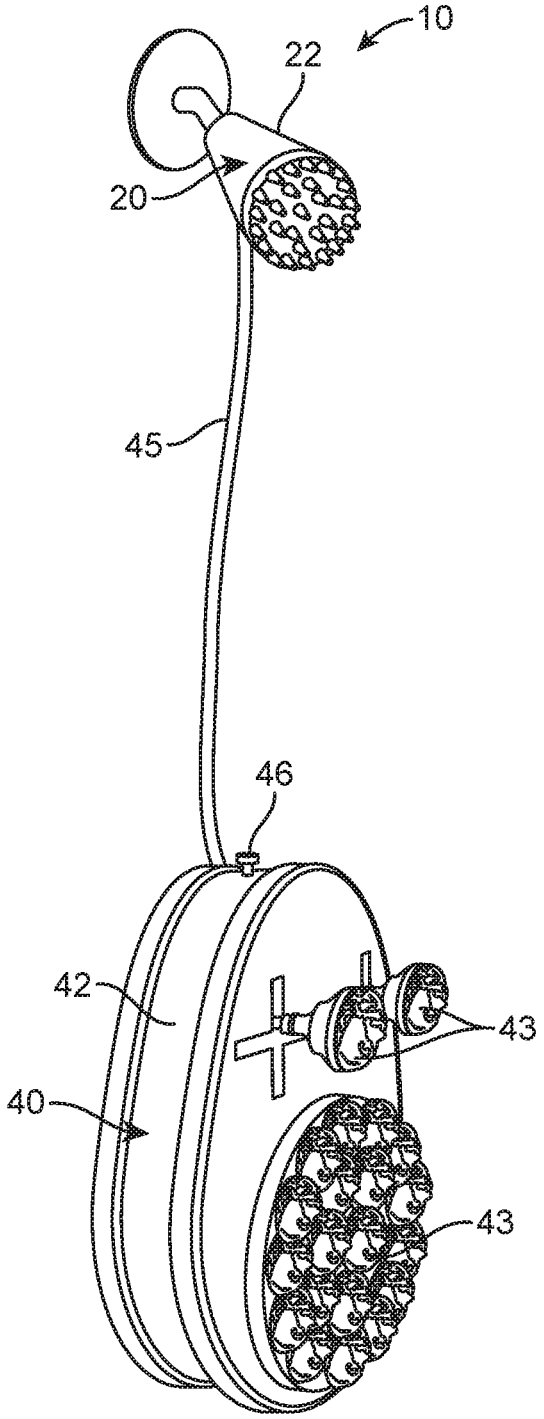
FIG. 2 shows represents an assembled configuration of shower head assembly 20 and brush body assembly 40 in accordance to an embodiment of the present invention.

Front end 42A includes brush portions 43 mounted thereon. In one embodiment as seen in FIG. 2, front end 42A includes three brush portions 43. Two identical circular brush portions are provided near a top end of front end 42A. These brush portions 43 are adjacently placed thereon. Additionally, a large circular brush portion is placed beneath the two smaller brush portions near a bottom end of front end 22B. In one implementation, brush portion 23 is provided as a loofah material which is mounted on a circular plate. It should be understood, that the loofah material may be replaced with any other form of brush or bristles that are known in the art of body washing. Additionally, brush portions 43 are replaceable and may be regularly exchanged in order to maintain proper hygiene of back and shoulder washing machine 10.

Figure 6:
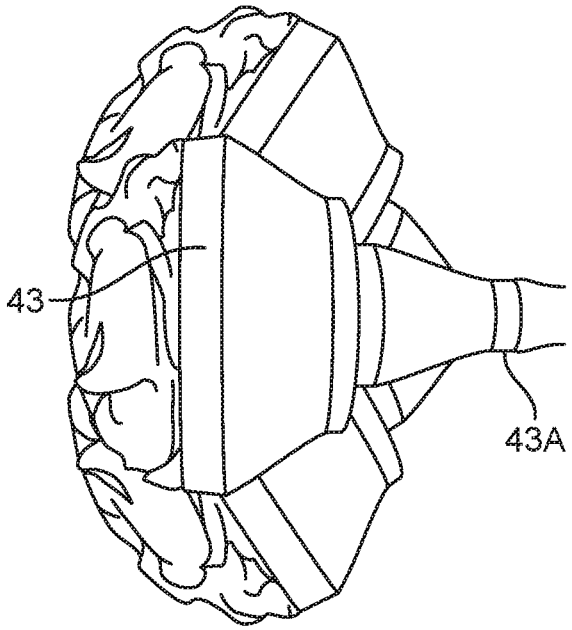
FIG. 6 illustrates a side view of brush portions 43 depicting a swiveling motion in accordance to an embodiment of the present invention.

Brush portions 43 are attached to an extendable rod 44 which extends outwardly and away from front end 42A. In one embodiment extendable rod 44 is provided as a telescopic rod which retrieves into body 42 when not in use. The extendable rod 44 allows brush portions 43 to properly wash a user's back without the user placing their back directly onto shower wall 50. This allows for a user to stand a comfortable position within the shower area while their back is being washed. In the present embodiment, brush portions 43 are hingedly attached to extendable rod 44 through a hinged connection 43A as seen in FIG. 6 of the provided specifications. this connection allows brush portions 43 to preform swiveling vertical and horizontal movements when cleaning a user's back. Such a motion ensures that the entire area of a user's back is covered when utilizing the present invention 10. Additionally, extendable rod 44 is configured to have a spinning motion which in turn then spins brush portions 43. The combination of the spinning motion with the swiveling motion allows provides a user with the most effective back wash.

Figure 4:
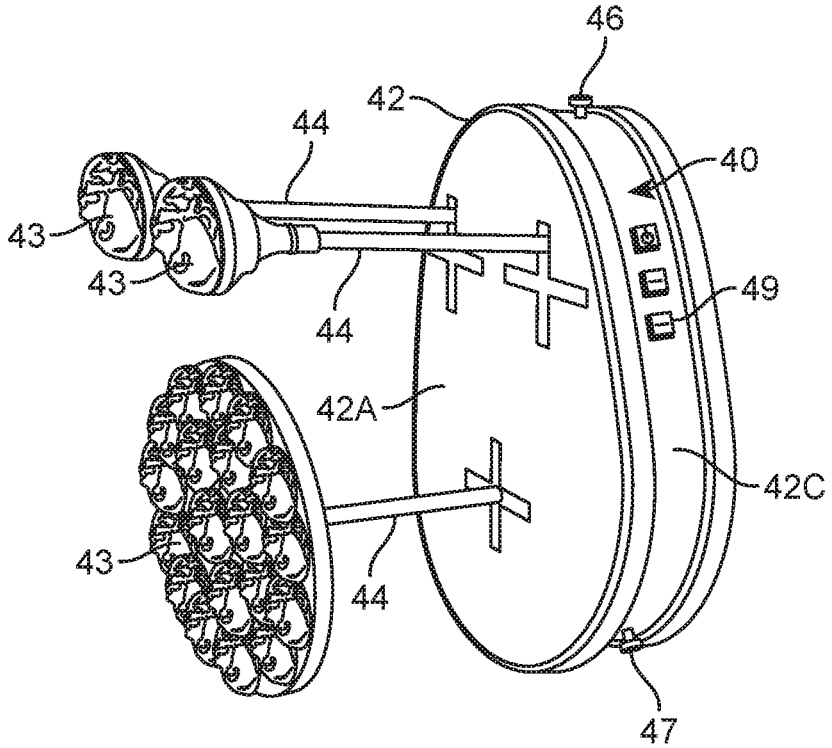
FIG. 4 is a representation of an isometric view of brush body assembly 40 depicting brush portions 43 in an extending position in accordance to an embodiment of the present invention.

Body 42 further includes a hose 45 mounted to a top end. Hose 45 is then received by hose receiving member 24 to establish fluid communication with shower head 22. As a result, water passing through shower head 22 is delivered into body 42 through hose 45. Hose 45 may be provided as a traditional water tube that is encased in metal or steel. Additionally, body 42 includes a reservoir 46 therein which is accessed by reservoir cap as seen in FIG. 4 of the provided drawings. In the present embodiment, reservoir 46 receives a cleaning solution therein which then fuses with the water received by body 42 to create a mixture. This mixture, then travels through an interior of extendable rod 44 to then be dispensed from brush portions 43. As a result, back and shoulder washing machine 10 provides a user with a soap and water mixture when having their back washed. The cleaning solution may be provided in several forms. Cleaning solution may be provided as a soap or lotion material. In another embodiment, the cleaning solution may be provided in a pod form which mixes with the water within body 42. Additionally, body 42 is provided with a release valve 47 located at a bottom end. Release valve 47 may be provided as a turnable valve which is actuated to reveal an opening within body 42. Excess water stored within body 42 is then drained from release valve 47 to be dispensed into the drain of the shower area. This aids in maintaining proper hygiene of the device itself when not in use.

Figure 5:
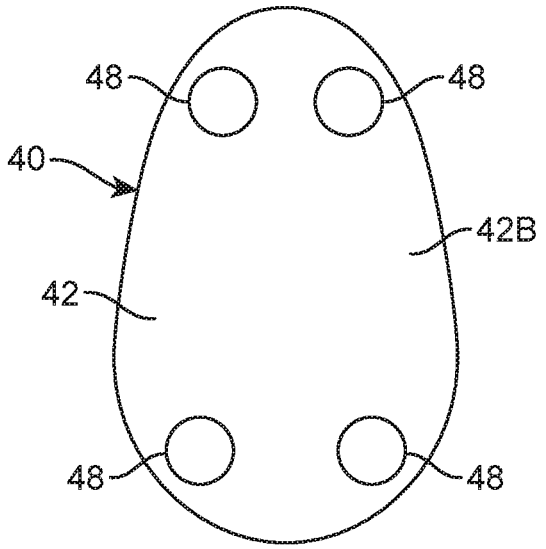
FIG. 5 shows a rear view of brush body assembly 40 depicting suction cups 48 in accordance to an embodiment of the present invention.

In the present embodiment, rear end 42B of body 42 includes suctions cups 48 mounted thereon. As observed in FIG. 5, at least four suctions cups may be provided for body 42. This configuration may include two suction cups at a top end in combination with two suction cups at a lower end. Suction cups 48 are coupled to shower wall 50 to create a secure attachment thereon. In one embodiment, an industrial strength glue is applied to suction cups 48 to aid in maintaining a secure connection to shower wall 50. Other embodiments of the present invention may feature other forms of attachment means other than suction cups 48.

Brush body assembly 40 further includes buttons 49 mounted along sidewalls 44C of body 42. Buttons 49 may be provided as rectangular buttons and are used to control various functions of the device. In one embodiment, buttons 49 include a power button which initiates the device and extends brush portions 43 outwardly to their fullest extension. The fullest extension of brush portions 43 may be provided as 12 inches. Once brush portions 43 are in an extended position, the mixture of soap and water is dispensed through brush portions 43. Additionally, the power button may be used to turn off the machine which retracts the brush portions 43 to join back with body 42. In one implementation, buttons 49 are provided with three functions, a power button to initiate the device, a button to automatically extend brush portions 43 and a button to initiate a spinning motion of brush portions 43. Additionally, a user is able to set the speed of rotation for brush portions 43 to a comfortable position.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a back and shoulder washing machine, comprising:

a) a shower head assembly including a shower head having a switch and a hose receiving member, wherein said switch engages said hose receiving member in an open position or a closed position; and b) a brush body assembly including a body having a front end, a rear end, and sidewalls, extendable rods extending perpendicularly from said front end, wherein said extendable rods are telescopic rods which retract inwardly and outwardly from said body, wherein said extendable rods are spinning rods, brush portions mounted to a distal end of said extendable rods through a hinged connection, a hose mounted to a top end of said body, wherein said hose receiving member receives said hose, a reservoir located at said top end of said body which receives a cleaning solution therein, a release valve located at a bottom end configured to release excess water from within said body, said back end including a plurality of suction cups mounted thereon.

2. The system for a back and shoulder washing machine of claim 1 wherein said hose receiving member is coupled to a bottom end of said shower head.

3. The system for a back and shoulder washing machine of claim 1 wherein said shower head has a conical shape.

4. The system for a back and shoulder washing machine of claim 1 wherein said body has an ovular shape.

5. The system for a back and shoulder washing machine of claim 1 wherein said brush portions are provided as a loofah material mounted onto a circular plate.

6. The system for a back and shoulder washing machine of claim 1 wherein said brush portions include a lower brush portion and two adjacent upper brush portions.

7. The system for a back and shoulder washing machine of claim 1 wherein said hose is encased in a metal material.

8. The system for a back and shoulder washing machine of claim 1 wherein said cleaning solution is in the form of a liquid soap or a cleaning pod.

9. The system for a back and shoulder washing machine of claim 1 wherein said suction cups are coupled to a shower wall of a shower area.

10. The system for a back and shoulder washing machine of claim 1 wherein said sidewalls include a plurality of buttons configured to control various settings of said back and shoulder washing machine.

11. A system for a back and shoulder washing machine, comprising:

a. a shower area having a shower wall;

b. a shower head assembly including a shower head having a conical shape mounted to said shower wall, wherein said shower head includes a hose receiving member mounted to a bottom end thereof, wherein said shower head includes a front end with a plurality of nozzles, said shower head further including a switch located on a side end which engages said hose receiving member into an open position or a closed position, said switch having a rectangular shape; and c. a brush body assembly including a body with an ovular shape having a front end, a rear end, and sidewalls, wherein said front end includes two upper adjacent brush portions and a lower brush portion, wherein said two upper adjacent brush portions have identical dimensions, wherein said lower brush portion is greater in size than said two upper adjacent brush portions, wherein said two upper adjacent brush portions and said lower brush portion are provided as a loofah mounted onto a circular plate, three extendable rods coupled said two upper adjacent brush portions and said lower brush portion through a hinged connection and mounted to said front end of said body, wherein said three extendable rods are telescopic rods extending outwardly and away from said body, wherein said body includes a hose mounted at a top end, wherein said hose is a water hose incased with a metal material, said hose received by said hose receiving member of said shower head, wherein said body further includes a reservoir which receives a cleaning solution in the form of soap, wherein said body includes a release valve located at a bottom end configured to release excess water from within said body, four suction cups mounted to said back end of said body, wherein said four suction cups are received by said shower wall to create a secure attachment, said sidewalls having a plurality of buttons thereon configured to control settings of said back and shoulder washing device.

* * * * *